US010443307B2

(12) United States Patent
Du et al.

(10) Patent No.: US 10,443,307 B2
(45) Date of Patent: Oct. 15, 2019

(54) ROTARY STEERABLE DRILLING TOOL AND METHOD OF CONTROL THEREOF

(71) Applicant: Institute of Geology and Geophysics, Chinese Academy of Sciences, Beijing (CN)

(72) Inventors: Jiansheng Du, Beijing (CN); Qingyun Di, Beijing (CN); Zili Wang, Beijing (CN); Wenxuan Chen, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/174,715

(22) Filed: Oct. 30, 2018

(65) Prior Publication Data

US 2019/0128070 A1 May 2, 2019

(30) Foreign Application Priority Data

Oct. 31, 2017 (CN) ..... 2017 1 1044207

(51) Int. Cl.
*E21B 7/06* (2006.01)
*E21B 44/00* (2006.01)

(52) U.S. Cl.
CPC ..... *E21B 7/064* (2013.01); *E21B 7/068* (2013.01); *E21B 44/00* (2013.01)

(58) Field of Classification Search
CPC ... E21B 7/04; E21B 7/06; E21B 7/062; E21B 7/067; E21B 7/068; E21B 44/00; E21B 44/005
See application file for complete search history.

(56) References Cited

U.S. PATENT DOCUMENTS 3,743,034 A * 7/1973 Bradley ..... E21B 7/06 175/61
6,109,372 A * 8/2000 Dorel ..... E21B 47/08 175/269
6,158,529 A * 12/2000 Dorel ..... E21B 7/067 175/61

(Continued)

FOREIGN PATENT DOCUMENTS

CA 2298375 A1 * 9/2000 ..... E21B 7/06

*Primary Examiner* — Jennifer H Gay

(74) *Attorney, Agent, or Firm* — Novick, Kim & Lee, PLLC; Allen Xue

(57) ABSTRACT

The static push-the-bit articulated high-built-rate rotary steerable tool has the main body of a non-rotary measurement and control unit articulated with the main body of a non-rotary actuator, rather than an integral structure. Due to the fact that the drilling tool is easy to bend in a wellbore, the bending stress in an upper portion of the steerable tool is low, and the consumption of the pushing force for bending deformation of the drilling tool is minimized. Since the steering sleeve around the main body of a load-bearing actuator only slides along the well wall in an axial direction without rotational friction there-between, the service life of the steering sleeve is long. Besides, since hydraulic pressure is used instead of pressure difference of mud to act on the pistons to form the pushing force, the pushing force is greatly improved, and the sealing life of the pistons is longer.

10 Claims, 12 Drawing Sheets

(56) References Cited

U.S. PATENT DOCUMENTS 6,427,783 B2 * 8/2002 Krueger ..... E21B 7/062 175/325.3
6,840,336 B2 * 1/2005 Schaaf ..... E21B 7/06 175/27
6,857,484 B1 * 2/2005 Helms ..... E21B 41/0085 175/57
7,383,897 B2 * 6/2008 Moody ..... E21B 7/062 175/61
7,389,830 B2 * 6/2008 Turner ..... E21B 7/062 175/61
7,762,356 B2 * 7/2010 Turner ..... E21B 7/062 175/61
9,109,402 B1 * 8/2015 Lasater ..... E21B 7/062
9,145,736 B2 * 9/2015 Peter ..... E21B 7/067
9,366,087 B2 * 6/2016 Sugiura ..... E21B 7/067
9,476,263 B2 * 10/2016 Clausen ..... E21B 7/06
9,702,200 B2 * 7/2017 Bowley ..... E21B 41/0085
10,066,438 B2 * 9/2018 Kirkhope ..... E21B 7/062
10,110,091 B2 * 10/2018 Gawski ..... H02K 7/1823
10,113,363 B2 * 10/2018 Cobern ..... G05B 19/402
10,161,196 B2 * 12/2018 Kirkhope ..... E21B 7/062
2001/0042643 A1 * 11/2001 Krueger ..... E21B 7/062 175/73
2002/0179336 A1 * 12/2002 Schaaf ..... E21B 7/06 175/61
2004/0256162 A1 * 12/2004 Helms ..... E21B 7/062 175/325.2
2006/0243487 A1 * 11/2006 Turner ..... E21B 7/062 175/26
2006/0283635 A1 * 12/2006 Moody ..... E21B 7/062 175/73
2009/0008151 A1 * 1/2009 Turner ..... E21B 7/062 175/45
2012/0018225 A1 * 1/2012 Peter ..... E21B 7/067 175/61
2012/0285746 A1 * 11/2012 Kvalvik ..... E21B 7/06 175/74
2014/0209389 A1 * 7/2014 Sugiura ..... E21B 7/067 175/73
2015/0008043 A1 * 1/2015 Clausen ..... E21B 7/06 175/57
2016/0130878 A1 * 5/2016 Cobern ..... G05B 19/402 175/25
2016/0348438 A1 * 12/2016 Kirkhope ..... E21B 7/062
2016/0356099 A1 * 12/2016 Kirkhope ..... E21B 7/062
2017/0122043 A1 * 5/2017 Shahipassand ..... E21B 17/1078
2018/0016845 A1 * 1/2018 Peters ..... E21B 4/02
2018/0080283 A1 * 3/2018 Wang ..... E21B 7/064
2019/0128070 A1 * 5/2019 Du ..... E21B 7/064

* cited by examiner

ROTARY STEERABLE DRILLING TOOL AND METHOD OF CONTROL THEREOF

CROSS REFERENCE TO RELATED APPLICATIONS

The present application claims the benefit of the Chinese patent application No. 201711044207.9, filed on Oct. 31, 2017 before the Chinese Patent Office, entitled "Static Internal Pushing Hinged-Type High-Deflecting-Rate Rotary Guiding Tool and Control Method", the contents of which are incorporated herein by reference in their entirety.

TECHNICAL FIELD

The present invention mainly belongs to the technical field of rotary steerable systems, and particularly relates to a static push-the-bit articulated high-built-rate rotary steerable tool and a control method thereof.

BACKGROUND ART

Rotary steerable technology belongs to the field of directional drilling, and is mainly used for drilling three trajectory wells such as directional wells, horizontal wells and extended reach wells, etc. Relying on a high-precision servo control mechanism and high-precision D&I measurement sensors, it can accurately control the drilling direction of a drill bit in real time, and thereby controls a wellbore trajectory. Existing conventional low-built-rate (6.5°/30 m) rotary steerable tools can't meet the requirements for drilling directional shale gas wells and offshore or land high-DLS wells anymore.

The AutoTrak Curve rotary steerable tool from Baker Hughes Incorporated employs three sets of hydraulic push-the-bit cylinders and their auxiliary ribs to push against the well wall. Under the pushing forces, the upper portion of the steerable tool is bent and deformed integrally, so that a fixed angle is formed between the axial direction of the wellbore trajectory and the axial direction of the steerable tool, and thereby a building angle is created. A disadvantage of such a structure is that bending the upper portion of the steerable tool consumes the pushing forces, and the bending caused by the pushing forces aggravates the bending stress in the drilling stem at the upper portion. Consequently, in a large-curvature wellbore, the drilling tool at the upper portion is prone to have alternating fatigue damages. As a result, there is a high requirement for the strength of the metal material of the drilling tool at the upper portion. It is hard for the steerable system to achieve a higher built rate, because the entire tool system is deformed integrally in the wellbore. Moreover, the ribs of the rotary steerable tool from Baker Hughes Incorporated suffer severe abrasion, since they push against the well wall.

The PD Archer rotary steerable tool from Schlumberger Limited employs a structure in which the main body of a measurement and control unit is articulated with the main body of a universal mechanism, four sets of pushing pistons located at the lower end of the main body of the measurement and control unit push against the inner wall of a steering sleeve around the main body of the universal mechanism at the lower portion, and thereby the direction of the drill bit is controlled. Since the tool system employs a full-rotary design concept and utilizes mud pressure to drive the pistons, the steering sleeve around the main body of the universal mechanism bears high force, may be worn out more easily in a rotation state, and has a short service life.

Furthermore, the pistons are hard to seal and may have a shortened service life because the mud contains sand. Consequently, the entire rotary steerable tool system has a short overall service life and involves a higher maintenance and service cost.

Contents of the Invention

In view of the above-mentioned technical problems, the present invention provides a static push-the-bit articulated high-built-rate rotary steerable tool, and a method for controlling a rotary steerable system. The static push-the-bit articulated high-built-rate rotary steerable tool in the present invention employs a static push-the-bit articulated design concept in which the main body of a non-rotary measurement and control unit is articulated with the main body of a non-rotary actuator, rather than employs an integral structure. Owing to a fact that the drilling tool is easy to bend in a wellbore, the bending stress in an upper portion of the steerable tool is low, and the consumption of the pushing force for bending deformation of the drilling tool is minimized; since the steering sleeve around the main body of a load-bearing actuator only slides along the well wall in an axial direction without rotational friction there-between, the service life of the steering sleeve is long. Besides, since hydraulic pressure is used instead of pressure difference of mud to act on the pistons to form the pushing force, the pushing force is greatly improved, and the sealing life of the pistons is longer. Therefore, the apparatus in the present invention can achieve a higher built rate easily, and has an advantage of longer drilling service life.

The object of the present invention is attained with the following technical scheme:

A static push-the-bit articulated high-built-rate rotary steerable tool, comprising a rotary mandrel, a drill bit shaft, a universal joint connecting the rotary mandrel with the drill bit shaft, and a first non-rotary steering sleeve and a second non-rotary steering sleeve that are disposed around the rotary mandrel, wherein, the universal joint is disposed inside the second non-rotary steering sleeve; the first non-rotary steering sleeve (4) is supported on the mandrel (7) by means of a lower mud bearing (5) and an upper mud bearing (6). A stator coil in a non-contact electric power transmission assembly (3) is mounted inside the first non-rotary steering sleeve (4), and a rotor coil of the non-contact electric power transmission assembly (3) is positioned on the mandrel (7) and rotates together with the mandrel (7). A central control circuit (2) is also mounted inside the inner hole of the first non-rotary steering sleeve (4). For the convenience of maintenance and service, three sets of independent motor pump hydraulic modules (1) are secured to the first non-rotary steering sleeve (4) by bolts.

The rotary mandrel is articulated with the universal joint, so as to transmit drilling pressure and torque for drilling to a drill bit and realize universal articulation of the first non-rotary steering sleeve and the second non-rotary steering sleeve as well;

The first non-rotary steering sleeve and the second non-rotary steering sleeve are isolated from the rotation of the rotary mandrel by means of an upper mud bearing, a lower mud bearing and a near-bit-end mud bearing, so that the first non-rotary steering sleeve and the second non-rotary steering sleeve are kept in a quasi-stationary or non-rotary state with respect to the ground.

Furthermore, the first non-rotary steering sleeve is positioned in axial direction and radial location by means of the upper mud bearing and the lower mud bearing, and is isolated from the rotational movement of the rotary mandrel, so that the first non-rotary steering sleeve is kept in a quasi-stationary or non-rotary state with respect to the ground.

Furthermore, the second non-rotary steering sleeve is positioned in axial direction and radial location by means of the near-bit-end mud bearing, and is isolated from the rotational movement of the drill bit shaft, so that the second non-rotary steering sleeve is kept in a non-rotary quasi-stationary state in a wellbore.

Furthermore, a bow spring device is mounted on the first non-rotary steering sleeve, and is retained on the first non-rotary steering sleeve by a retaining cover; the outer diameter of the bow spring device is greater than the diameter of the wellbore, and the bow spring device abuts against the well wall by virtue of its compressive spring force in the wellbore to prevent the first non-rotary steering sleeve from rotating quickly incurred by a friction force of the mud bearings, and thereby keeps the first non-rotary steering sleeve in the quasi-stationary state.

Furthermore, wear-resistant ribs are mounted outside the second non-rotary steering sleeve; the outer circumference of each of the wear-resistant ribs has zigzag structures, and several hard alloy blocks for improving wear resistance are inlaid among the zigzag structures; and the wear-resistant ribs are evenly distributed on the outer circumference of the second non-rotary steering sleeve.

Furthermore, the rotary steerable tool further comprises a centering connecting shaft, a first circuit disposed on the rotary mandrel, a central control circuit, and three sets of independent motor pump hydraulic modules; and each set of motor pump hydraulic modules comprises at least one set of pushing pistons; and electric power and communication signals from a MWD are transferred to the first circuit via the centering connecting shaft, the first circuit transfers the electric power subjected to high-frequency modulation and the signals subjected to carrier modulation to the central control circuit via a non-contact electric power transmission assembly, motor controllers in the central control circuit drive the three sets of independent motor pump hydraulic modules, hydraulic systems in the motor pump hydraulic modules generate high-pressure oil sources and feed high-pressure oil into the pushing pistons, and vector resultants of three coplanar concurrent force systems are formed by separately controlling the oil pressure acting on each set of pushing pistons, so as to form a resultant force vector, which acts on the inner wall of the second non-rotary steering sleeve so that the drill bit shaft is deflected around an articulation point defined by the universal joint and thereby forms an angle with respect to the axis of the rotary steerable tool; and by controlling the magnitude and direction of the resultant force vector, a lateral force acting on the drill bit is controlled accurately, and thereby the drilling direction of the drill bit is controlled.

Furthermore, the first circuit is sealed in a cavity in an upper portion of the rotary mandrel by a sealing cover plate; and the first circuit is electrically connected with the centering connecting shaft via a connector.

Furthermore, the three sets of independent motor pump hydraulic modules are fixed on the first non-rotary steering sleeve by screws.

Furthermore, a mud turbine generator for supplying electric power is disposed on the rotary steerable tool, positioned at an inner shoulder of a sub of a drill collar, and connected with an upper-end interface of the rotary steerable tool via a lower-end interface of the mud turbine generator by insertion, so that the sub of the drill collar with the generator is electrically connected with the rotary steerable tool; and a guiding connection base is provided on a lower portion of the mud turbine generator, an electrical connector is provided in the guiding connection base, and the mud turbine generator is pushed into the guiding connection base in an axial direction, so as to realize positioning and transfer electric power from of the mud turbine generator to the first circuit via the electrical connector as well.

A method for controlling a static push-the-bit articulated high-built-rate rotary steerable tool, comprising:

receiving a current target tool face as a target execution instruction, by a central control circuit;

acquiring signals from sensors and calculating a current tool face, by the central control circuit;

calculating a target steering force vector according to the target tool face, and decomposing the target steering force vector into three separate hydraulic pressures, by a central control circuit system;

transmitting hydraulic pressure commands to three sets of independent motor controllers, which drive three sets of independent motor pump hydraulic modules respectively, and acquiring operating pressures of hydraulic systems and controlling the operating pressures by closed-loop control in real-time at high precision, so that the current steering force vector approaches to the target steerable force vector and is maintained at the target steering force vector all the time;

acquiring and monitoring a current gravitational tool face value in real time, by the central control circuit system, and, if the current gravitational tool face value varies, recalculating the target steering force vector and decomposing the recalculated target steering force vector into three separate hydraulic pressures, by the central control circuit system; and driving the three sets of independent motor pump hydraulic modules respectively by the three sets of independent motor controllers, and acquiring the operating pressures of the hydraulic systems and controlling the operating pressures by closed-loop control in real time at high precision, so that the current steering force vector approaches to the reassigned target steering force vector and is maintained at the target steering force vector all the time; and controlling a drill bit under the action of the target steering force vector all the time to drive a well according to a required wellbore trajectory.

The Present Invention has Advantageous Technical Effects:

The rotary steerable tool in the present invention employs a static push-the-bit articulated design concept in which the main body of a non-rotary measurement and control unit is articulated with the main body of a non-rotary actuator, rather than employs an integral structure. Owing to a fact that the drilling tool is easy to bend in a wellbore, the bending stress in an upper portion of the steerable tool is low, and the consumption of the pushing force for bending deformation of the drilling tool is minimized; since the steering sleeve around the main body of a load-bearing actuator only slides along the well wall in an axial direction without rotational friction there-between, the service life of the steering sleeve is long. Besides, since hydraulic pressure is used instead of pressure difference of mud to act on the pistons to form the pushing force, the pushing force is greatly improved, and the sealing life of the pistons is longer. Therefore, the apparatus in the present invention can achieve a higher built rate easily, and has an advantage of longer drilling service life.

REFERENCE NUMBERS

1—motor pump hydraulic module; 2—central control circuit; 3—non-contact electric power transmission assembly; 4—first non-rotary steering sleeve; 5—lower mud bearing; 6—upper mud bearing; 7—rotary mandrel; 8—sealing cover plate; 9—first circuit; 10—far-bit-end centralizer; 11—centering connecting shaft; 11.1—lower electrical connector; 12—second non-rotary steering sleeve; 12.1—wear-resistant rib; 12*a*—zigzag structure of wear-resistant rib of non-rotary steering sleeve at lower portion; 13—universal joint; 14—near-bit-end mud bearing; 15—drill bit shaft; 16—pushing piston; 16.1—first set of pushing pistons; 16.2—second set of pushing pistons; 17—drill collar for generator; 18—mud turbine generator; 18.1—electric connector at lower portion of generator; 19—bow spring device; 20—retaining cover; 21—connecting base; 21.1—electrical connector; 22—motor pump valve assembly; 23—fixing screw

EMBODIMENTS

Hereunder the present invention will be further detailed in embodiments with reference to the accompanying drawings, to make the object, technical scheme, and advantages of the present invention understood more clearly. It should be understood that the embodiments described here are only provided to explain the present invention, but shall not be deemed as constituting any limitation to the present invention.

Rather, the present invention is intended to encompass any alternation, modification, equivalent method or scheme worked out without departing from the spirit and scope of the present invention as defined by the claims. Furthermore, some specific details are described in at large in the following detailed description of the present invention, to enable the public to understand the present invention better. However, those skilled in the art can fully understand the present invention even without the description of those details.

Embodiment 1

Figure 1:
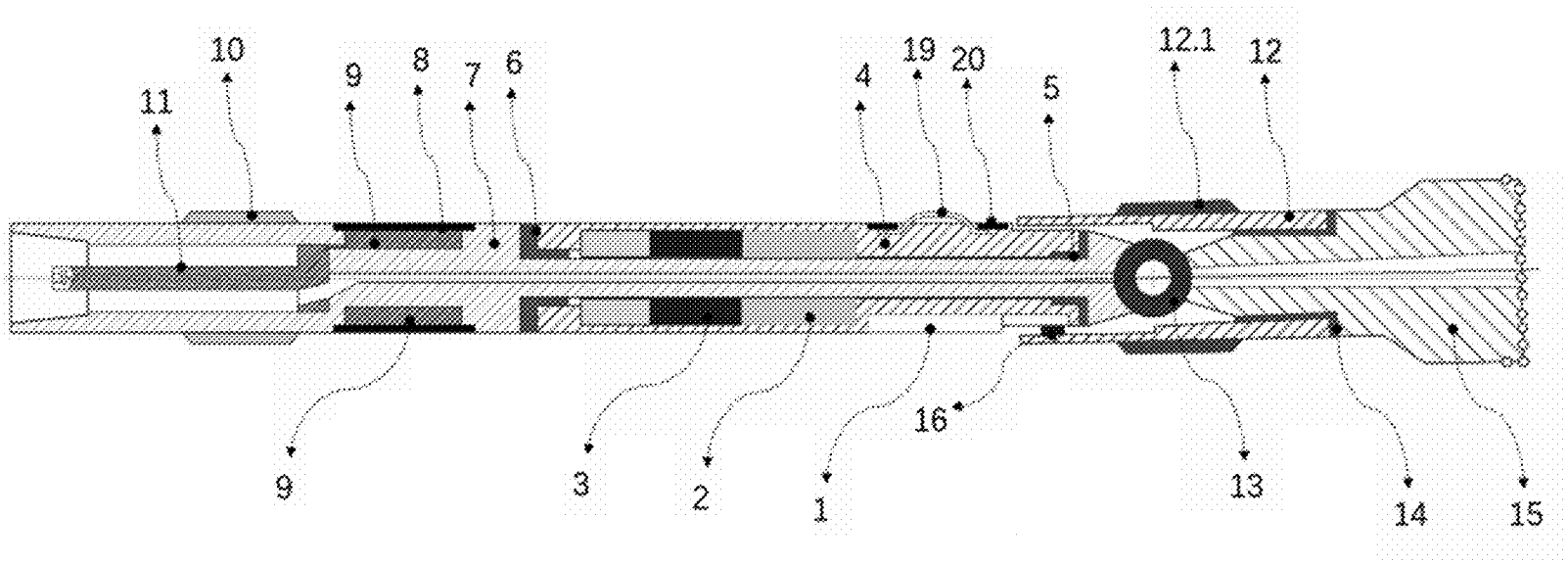
FIG. 1 is a schematic structural diagram of the static push-the-bit articulated high-built-rate rotary steerable tool according to embodiment 1.
Figure 2:
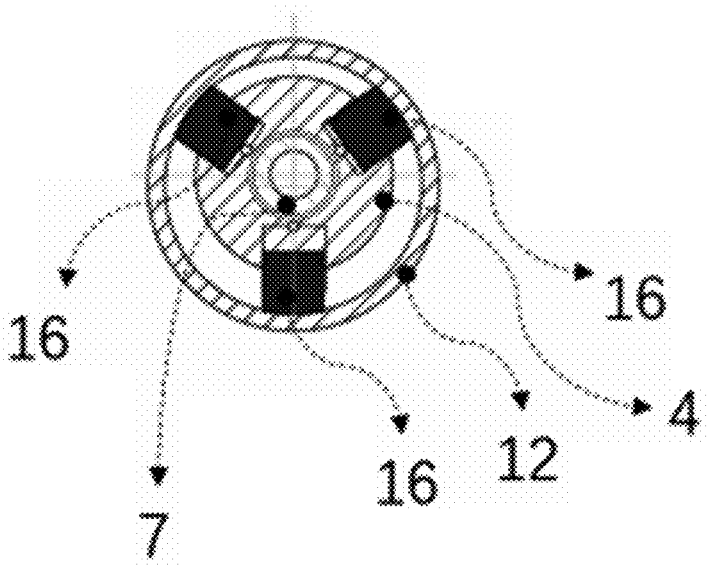
FIG. 2 is a schematic diagram showing a cross section of the static push-the-bit articulated high-built-rate rotary steerable tool at the pushing pistons according to embodiment 1.

In this embodiment, a static push-the-bit high-built-rate rotary steerable tool is provided. The static push-the-bit articulated high-built-rate rotary steerable tool comprise a rotary mandrel 7, a drill bit shaft 15, a universal joint 13 connecting the rotary mandrel 7 with the drill bit shaft 15, a first non-rotary steering sleeve 4 and a second non-rotary steering sleeve 12; as shown in FIGS. 1-2, the rotary mandrel 7 is connected with the universal joint 13, so as to transfer drilling pressure and torque for drilling to a drill bit. At the same time, the first non-rotary steering sleeve 4 is articulated with the second non-rotary steering sleeve 12 by universal articulation, and the articulation constitutes an articulation feature. The first non-rotary steering sleeve is isolated from the rotational movement of the rotary mandrel 7 by means of the upper mud bearing 6 and the lower mud bearing 5. At the same time, the first non-rotary steering sleeve 4 is positioned in axial direction and radial location by the upper mud bearing 6 and the lower mud bearing 5. Moreover, a bow spring device 19 is mounted on the first non-rotary steering sleeve 4, and is retained on the first non-rotary steering sleeve 4 by a retaining cover 20. Since the outer diameter of the bow spring device is greater than the diameter of the wellbore, the bow spring device abuts against the well wall by virtue of its compressive spring force in the wellbore to prevent the first non-rotary steering sleeve 4 from rotating quickly incurred by a friction force of the mud bearings or the like, and thereby keeps the first non-rotary steering sleeve 4 in a quasi-stationary state.

The second non-rotary steering sleeve 12 is isolated from the rotational movement of the drill bit shaft 15 by means of the near-bit-end mud bearing 14, so that the second non-rotary steering sleeve 12 is kept in a non-rotary state in the wellbore. At the same time, the second non-rotary steering sleeve 12 is positioned in axial direction and radial location, and can bear bidirectional force in the axial direction.

The first circuit 9 mainly comprises a communication circuit and an electric power carrier modulation circuit. The mandrel is designed with a far-bit-end centralizer 10 at its upper portion to inhibit radial vibration of the drilling tool and provide protection for the first circuit 9 in the vibration process of well drilling. The first circuit 9 is sealed inside a cavity in the upper portion of the rotary mandrel 7 by the sealing cover plate 8. In comparison with a built-in instrument compartment structure, that feature has advantages including less axial space occupation and convenient maintenance and service, etc. An electrical interface in the first circuit 9 is electrically connected to the centering connecting shaft 11 via a connector. Electric power and communication signals from a MWD are transferred via the centering connecting shaft 11 to the first circuit 9 of the rotary mandrel, the carrier modulation circuit in the first circuit 9 modulates the electric power by high-frequency modulation and modulates the signals by carrier modulation, and then transfers the modulated electric power and signals via a non-contact power transmission transformer 3 to the central control circuit 2, motor controllers in the central control circuit 2 drive the three sets of independent motor pump hydraulic modules 1, and hydraulic systems generate high-pressure oil sources and feed high-pressure oil via oil circuits in the hydraulic modules to three sets of pistons 16 inside the second non-rotary steering sleeve 12. In this embodiment, three sets of independent motor pump hydraulic modules 1 are used, and the motor pump hydraulic modules 1 are fixed to the first non-rotary steering sleeve 4 by several screws 23. Therefore, the motor pump hydraulic modules 1 are kept in a quasi-stationary state with respect to the ground.

Vector resultants of three coplanar concurrent force systems are formed by controlling the oil pressure acting on each set of pistons respectively, and thereby a resultant force vector is formed. The resultant force vector acts on the inner wall of the second non-rotary steering sleeve 12, so that the drill bit shaft is deflected around an articulation point defined by the universal joint 13, and forms an included angle with respect to the axis of the rotary steerable tool. At this point, the resultant force vector acting on the hydraulic piston and the lateral force on the drill bit establish a level force equilibrium, with the articulation point defined by the universal joint as a fulcrum. By controlling the magnitude and direction of the resultant force vector, a lateral force acting on the drill bit is controlled accurately, and thereby the drilling direction of the drill bit is controlled.

As describe above, in this embodiment, the first non-rotary steering sleeve 4 and the second non-rotary steering sleeve 12, on which the motor pump hydraulic modules 1 are mounted, are isolated from the rotation of the rotary mandrel by means of the upper mud bearing 6, the lower mud bearing 5, and the near-bit-end mud bearing 14, so that the first non-rotary steering sleeve 4 and the second non-rotary steering sleeve 12 are kept in a quasi-stationary or non-rotary state with respect to the ground. The stationary or non-rotary state constitutes a main feature of the static push-the-bit design of the rotary steerable tool in this embodiment.

Embodiment 2

Figure 3:
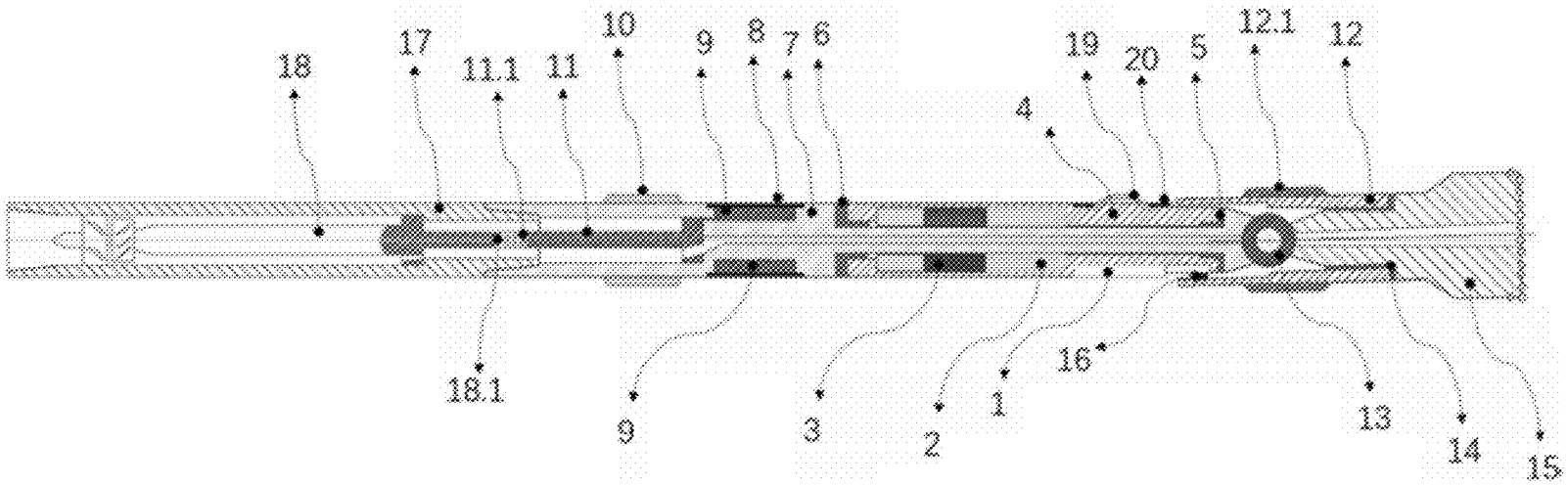
FIG. 3 shows the static push-the-bit articulated high-built-rate rotary steerable tool system in a sub of a drill collar with a generator according to embodiment 2.

In this embodiment, a static push-the-bit articulated high-built-rate rotary steerable tool in a sub of drill collar with a generator is provided, wherein the static push-the-bit articulated high-built-rate rotary steerable tool is the same as that in the embodiment 1, and this embodiment is specifically implemented as follows:

As shown in FIG. 3, in this embodiment, a mud turbine generator 18 for supplying electric power is positioned at an internal shoulder of a sub of a drill collar 17, and is connected via a lower-end interface 18.1 of the generator to an upper-end interface 11.1 of the rotary steerable tool by insertion, so that the sub of the drill collar with the generator is electrically connected with the rotary steerable tool. Since a split assembly consisting of the sub of the drill collar with the generator and the rotary steerable tool is employed, the apparatus in this embodiment has advantages, for example, the assembly can be assembled flexibly and conveniently, the drill collar 7 for the rotary mandrel is easy to process and manufacture, and the manufacturing cost is low, etc.

Figure 4:
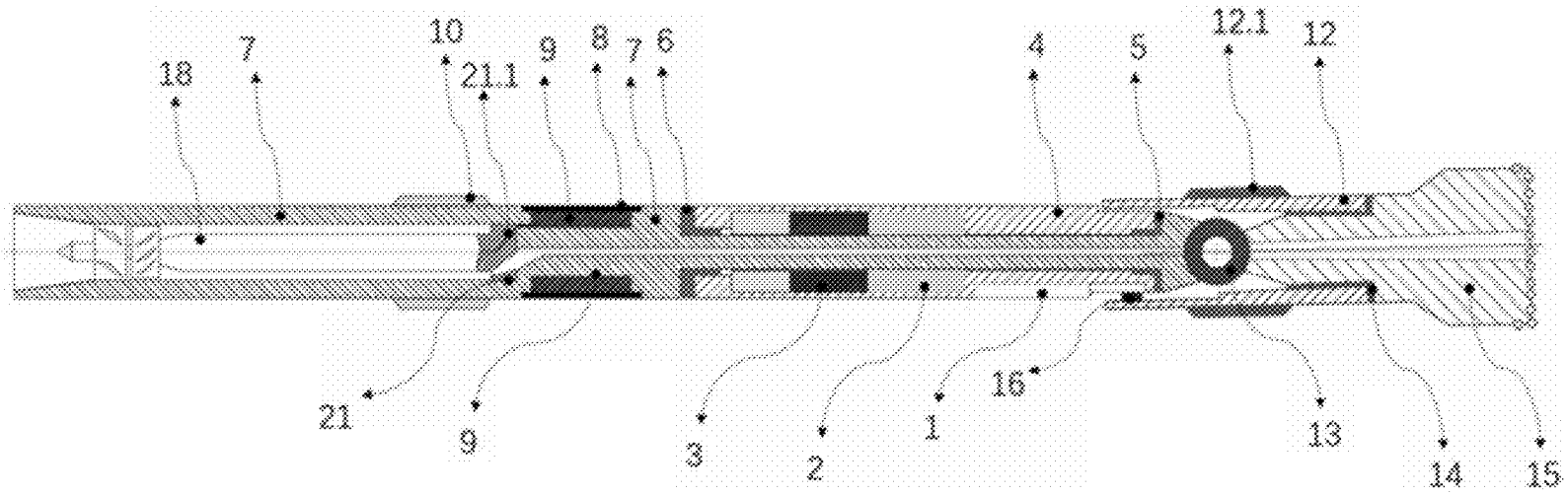
FIG. 4 shows the static push-the-bit articulated high-built-rate rotary steerable tool system integrated with a generator according to embodiment 2.

As shown in FIG. 4, in this embodiment, a static push-the-bit articulated high-built-rate rotary steerable tool integrated with a generator is further provided, and is specifically implemented as follows:

A guiding connection base is provided on a lower portion of the mud turbine generator 18 for supplying electric power, an electrical connector 21.1 is provided in the guiding connection base 21 and generator 18 positioned on a shoulder of an inner hole in the upper portion of the rotary mandrel by insertion in the axial direction, so as to realize positioning and transfer the electric power of the generator to the first circuit 9 via the electrical connector as well. Since the mud turbine generator 18 is directly positioned inside the drill collar 7 of the rotary mandrel of the rotary steerable tool, an electrical interface is reduced, and the apparatus provided in the present invention has characteristics such as compact structure and high reliability, etc.

In this embodiment, a single-piston hydraulic push-the-bit assembly is further provided. As shown in 6-8, the electric power supplied by the turbine generator 18 is used to drive the hydraulic systems in the hydraulic modules via the central control circuit 2. Since a hydraulic scheme is employed, the pushing pistons provide higher output, and thereby the drill bit obtains higher lateral cutting force, and achieves a higher built rate. The three sets of motor pump hydraulic modules 1 are fixed on the first non-rotary steering sleeve 4 by several bolts 23, so that they are kept in a stationary state with respect to the ground. The hydraulic modules 1 contain motors, pumps, and valve assemblies 22, and contain a first set of pushing pistons 16.1 as well. The first set of pushing piston 16.1 is of a bulb structure. The high-pressure oil produced by the hydraulic systems flows into the first set of pushing pistons 16.1 through high-pressure oil passages in the hydraulic modules 1. The pushing force of the first set of pushing pistons 16.1 acts on the inner wall of the second non-rotary steering sleeve 12.

Figure 9:
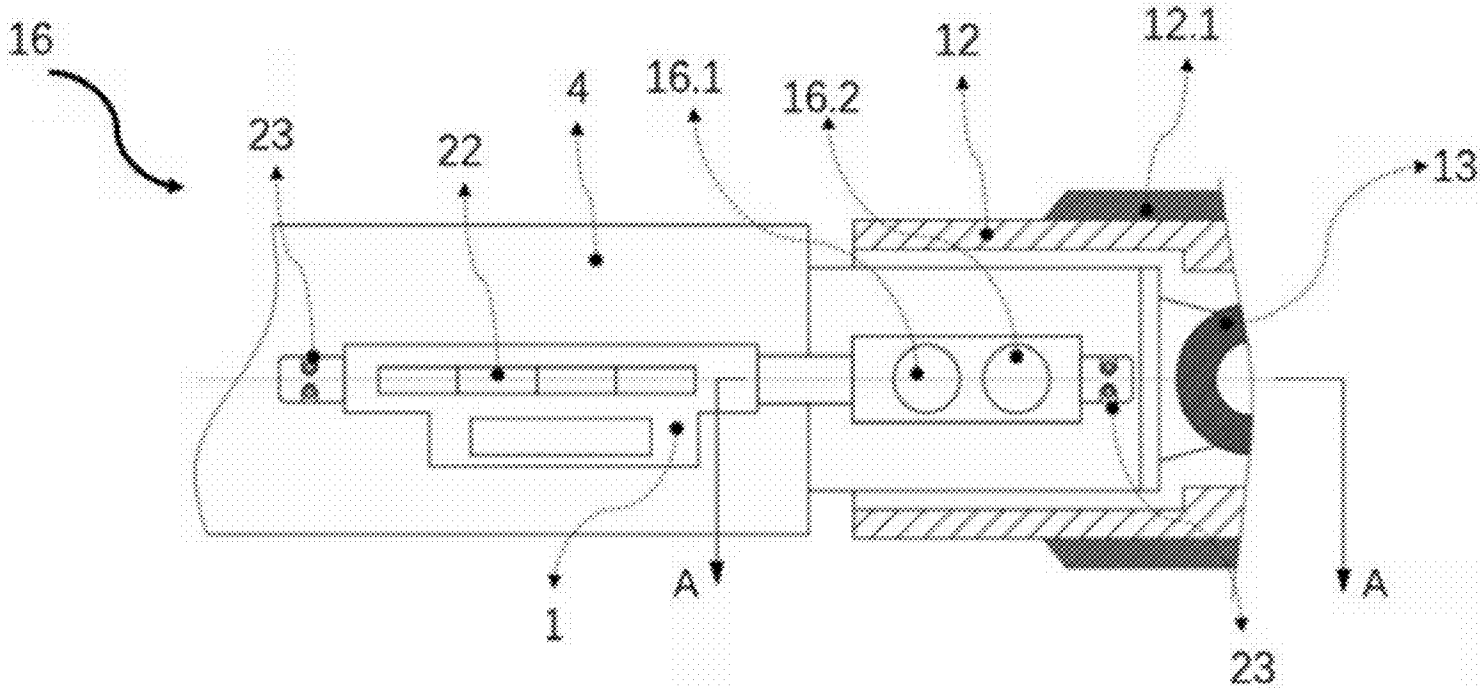
FIGS. 9-10 show the dual-piston hydraulic push-the-bit assembly according to embodiment 2.
Figure 10:
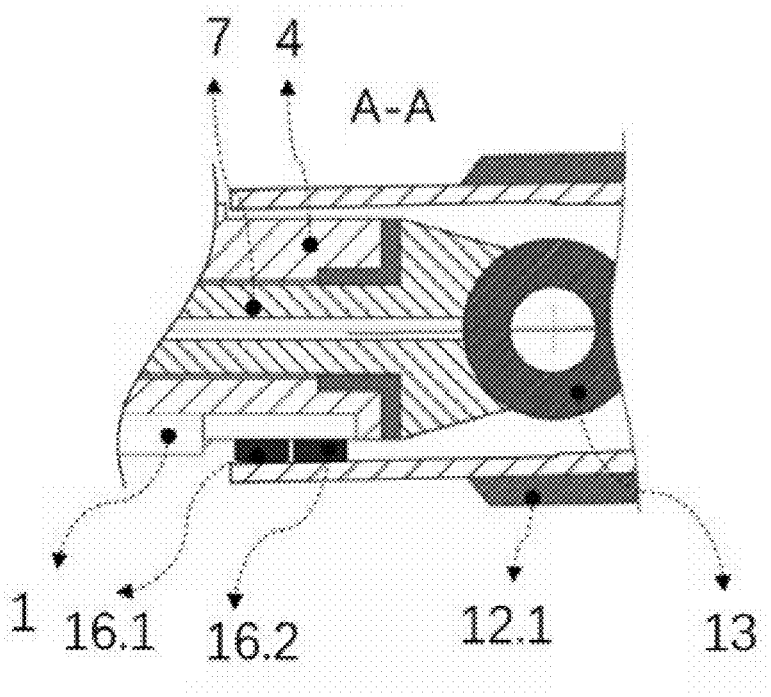

In addition, a dual-piston hydraulic push-the-bit assembly is further provided. The specific implementation of the dual-piston hydraulic push-the-bit assembly is shown in FIGS. 9-10: The three sets of motor pump hydraulic modules 1 are fixed on the first non-rotary steering sleeve 4 by several bolts 23, so that they are kept in a stationary state with respect to the ground. The motor pump hydraulic modules 1 contain motors, pumps, and valve assemblies 22, and contain two sets of pushing pistons 16.1 as well, including a first set of pushing pistons 16.1 and a second set of pushing pistons 16.2, both of which are of a bulb structure. The high-pressure oil produced by the hydraulic systems flows into the first set of pushing pistons 16.1 and the second set of pushing pistons 16.2 through high-pressure oil passages in the motor pump hydraulic modules 1. The pushing force formed jointly by the two sets of pushing pistons acts on the inner wall of the second non-rotary steering sleeve 12. With the dual-piston feature, the contact stress of the pistons acting on the inner wall of the second non-rotary steering sleeve 12 is smaller, and the pistons and the second non-rotary steering sleeve 12 suffer less wearing and have a longer service life.

Embodiment 3

Figure 5A:
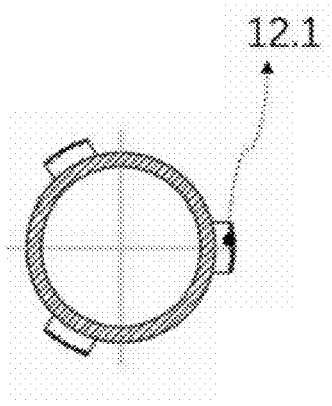
FIGS. 5A-5F are schematic structural diagrams of the second non-rotary steering sleeve 12 according to embodiment 3.
Figure 5B:
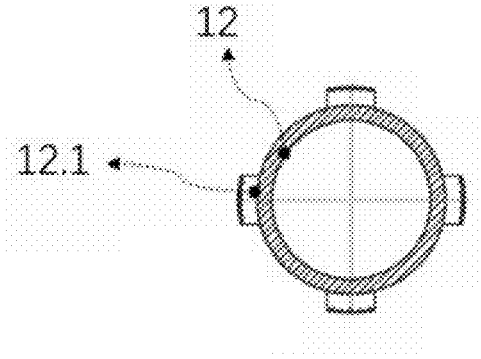
Figure 5C:
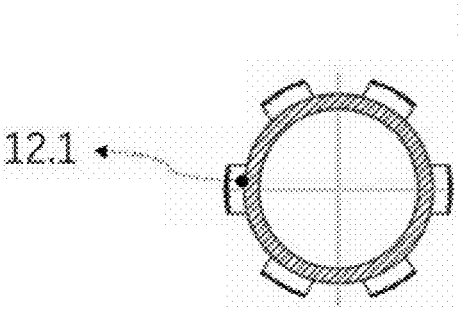
Figure 5D:
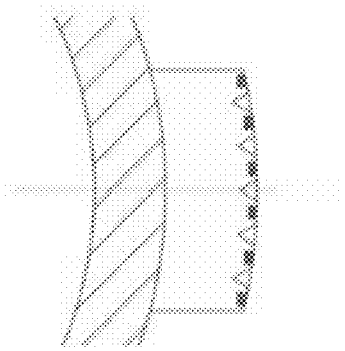
Figure 5E:
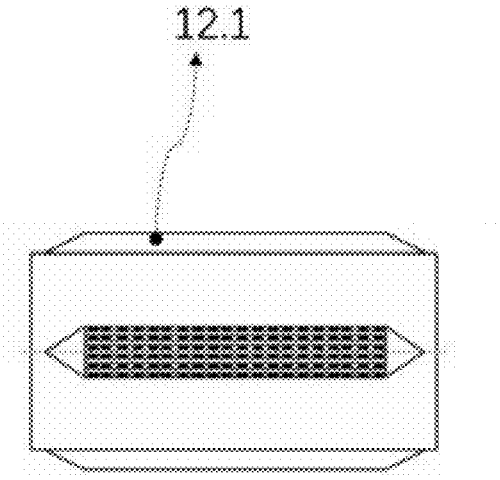
Figure 5F:
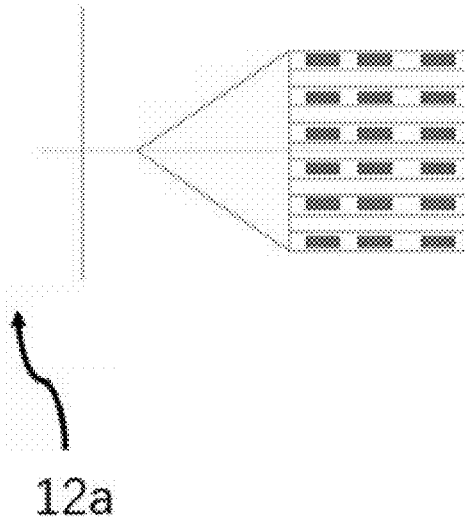
Figure 6:
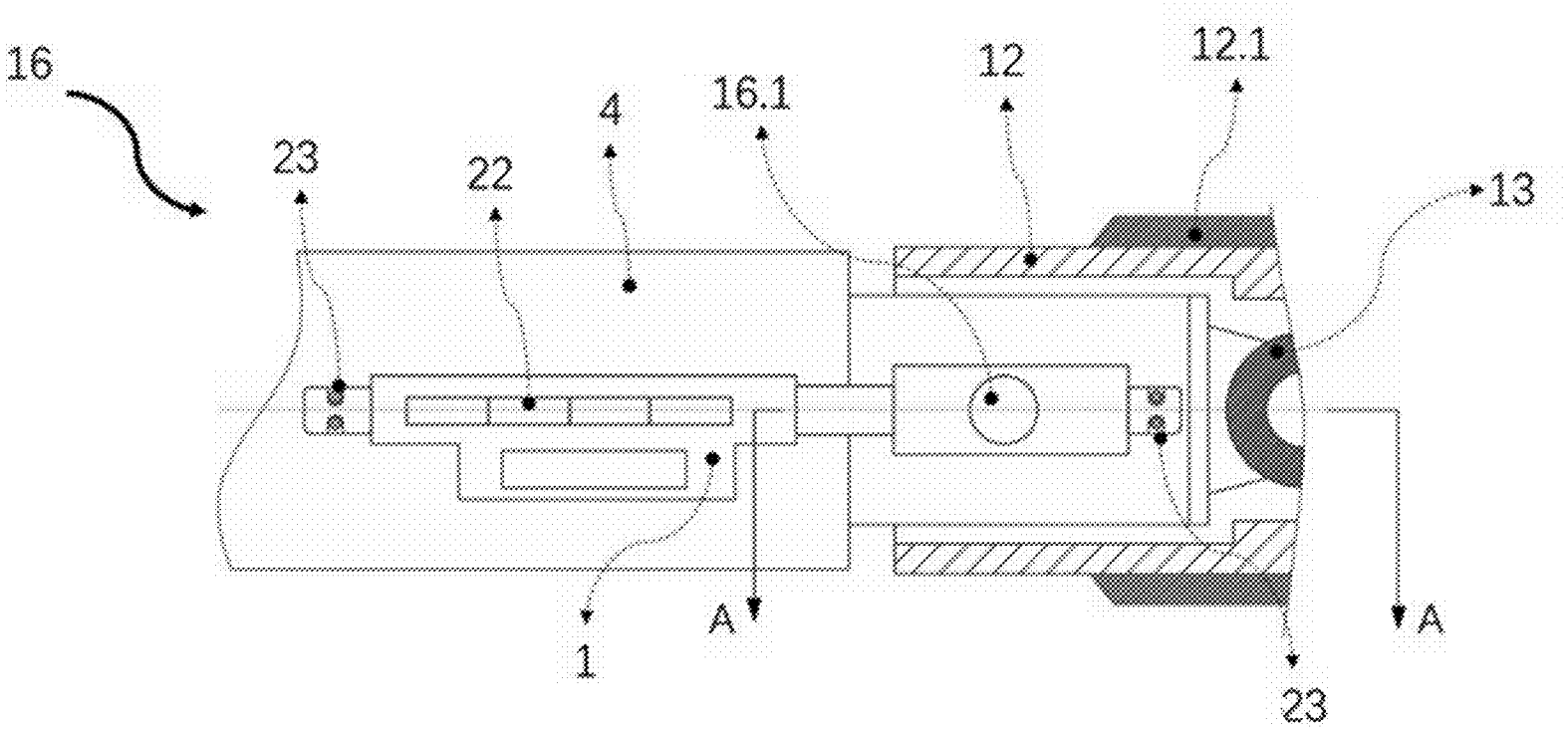
FIGS. 6-8 show the single-piston hydraulic push-the-bit assembly according to embodiment 2.
Figure 7:
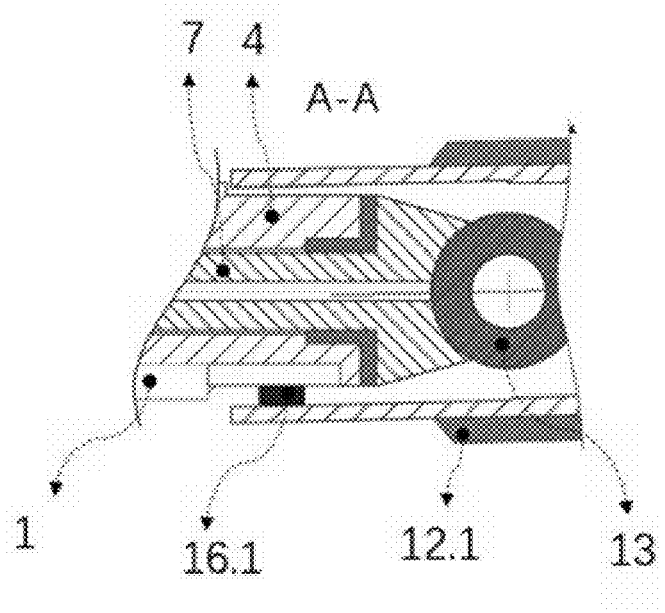
Figure 8:
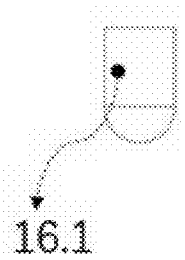

In this embodiment, a static push-the-bit high-built-rate rotation steerable tool is provided. The difference of this embodiment from the embodiment 1 is that a structure of the second non-rotary steering sleeve 12 is further provided in this embodiment to increase the rotary friction resistance between the second non-rotary steering sleeve and the well wall, so as to keep the second non-rotary steering sleeve in a quasi-stationary all the time. As shown in FIG. 5A-5F, the specific implementation is as follows:

The second non-rotary steering sleeve 12 is provided with wear-resistant ribs 12.1, which are straight wings. The outer circumference of each of the wear-resistant ribs has zigzag structures, and several hard alloy blocks are inlaid among the zigzag structures to improve wear resistance of the wear-resistant ribs 12.1. Besides, the wear-resistant ribs 12.1 may be three, four, or six sets of wear-resistant ribs, which are evenly distributed on the outer circumference of the second non-rotary steering sleeve 12, in the specific form as shown in FIGS. 5A-5C.

Embodiment 4

Figure 11:
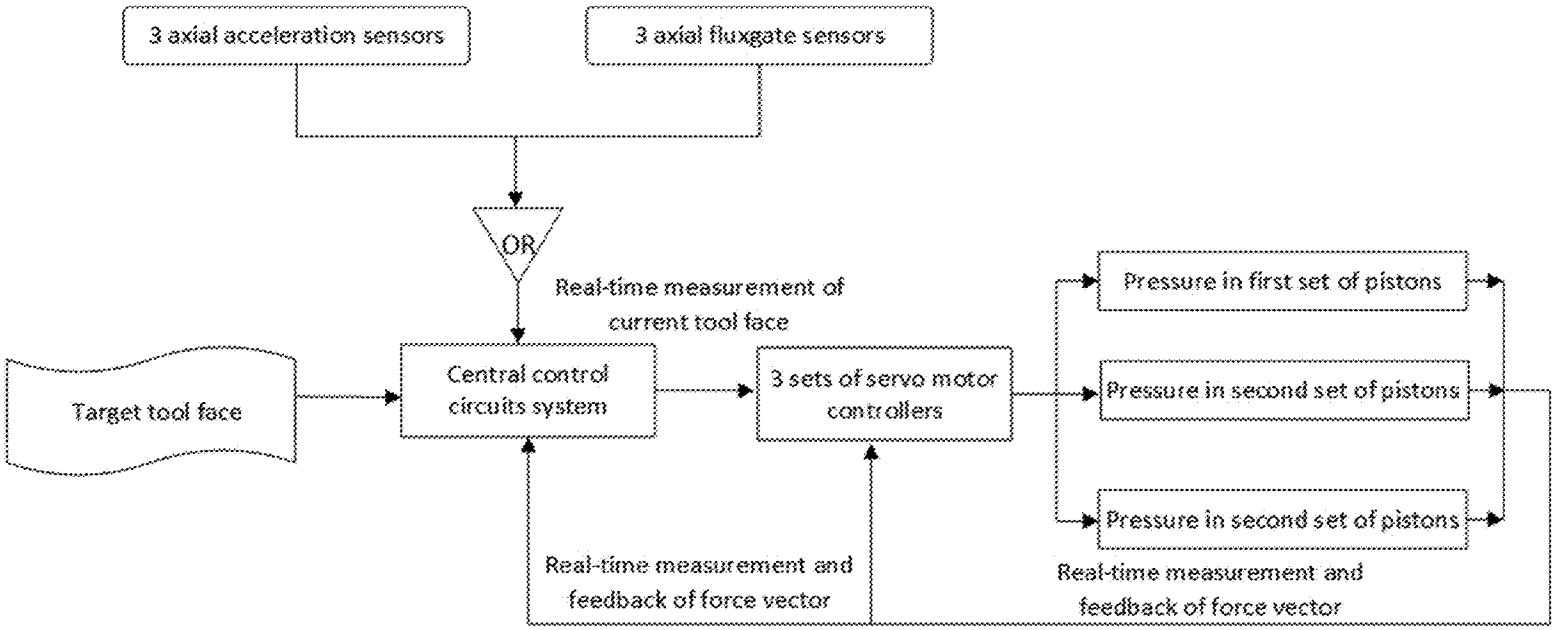
FIG. 11 is a control flow chart of a method for controlling a static push-the-bit articulated high-built-rate rotary steerable tool.

In this embodiment, a method for controlling a static push-the-bit articulated high-built-rate rotary steerable tool is provided. The specific implementation of the method is shown in FIG. 11:

A central control circuit 2 receives an instruction for current target tool face and deflection level, and takes the instruction as a target execution instruction. A target instruction always includes target tool face and deflection level. The central control circuit 2 acquires signals from a three-axis acceleration sensor and a fluxgate sensor, and calculates a current gravitational or magnetic tool face. If the well deflection is smaller than 5°, a magnetic tool face angle is calculated with the signal from the fluxgate sensor; if the well deflection is greater than 5°, a gravitational tool face angle is calculated with the signal from the three-axis acceleration sensor. The central control circuit 2 calculates a target steering force vector, which contains an instruction for target tool face and deflection level, according to the target tool face. Then, the central control circuit 2 decomposes the target steering force vector into three separate hydraulic pressures. Hydraulic pressure commands are transmitted through a communication bus to the three sets of independent servo motor controllers, which drive three sets of independent hydraulic modules respectively. The three sets of hydraulic modules provide high-pressure oil sources for three sets of pistons (a first set of pistons, a second set of pistons, and a third set of pistons) corresponding to them to drive the pistons to work. Each set of servo motor controllers acquires the operating pressure in each piston chamber at high precision in real time, provides a feedback and control the operating pressure by closed-loop control in real time, so that the current resultant force vector approaches to the target force vector and is kept at the target force vector all the time. The central control circuit 2 acquires and monitors the current gravitational tool face value in real time. If the current gravitational tool face value varies, the central control circuit system decomposes the resultant force vector into three separate hydraulic pressures again, so as to ensure that the tool face angle defined by the resultant force vector is consistent with the target tool face angle. The three sets of independent servo motor controllers drive the corresponding hydraulic modules according to the obtained recalculated resultant force vector, acquire the operating pressure in each hydraulic piston chamber and control the operating pressure by closed-loop control at high precision in real time, so that the current force vector approaches to the reassigned force vector and is kept at the reassigned force vector all the time. The drill bit is controlled under the action of the target steering force vector all the time to drive a well according to a required wellbore trajectory.

The invention claimed is:

1. A rotary steerable drilling tool, comprising:

a rotary mandrel;

a drill bit shaft connected to a drill bit;

a universal joint having a proximal portion connected to the rotary mandrel and a distal portion connected to the drill bit shaft;

a first non-rotary steering sleeve disposed around the rotary mandrel via an upper mud bearing and a lower mud bearing so that the rotary mandrel is rotatable relative to the first non-rotary steering sleeve;

a second non-rotary steering sleeve extends over the universal joint, wherein the second non-rotary steering sleeve has a distal portion disposed about the drill bit shaft and a proximal portion covering a distal portion of the first non-rotary steering sleeve, wherein a near-bit-end mud bearing is disposed between the distal portion of the second non-rotary steering sleeve so that the drill bit shaft is rotatable relative to the second non-rotary steering sleeve, wherein one or more pistons are disposed on the distal portion of the first non-rotary steering sleeve, and, when actuated, the one or more pistons press against an inner surface of the distal portion of the second non-rotary steering sleeve so that the drill bit shaft is deflected around an articulation point defined by the universal joint to adjust a direction of the drill bit shaft, and wherein the distal portion is disposed closer to the drill bit and the proximal portion is disposed further away from the drill bit.

2. The rotary steerable drilling tool according to claim 1, wherein the upper mud bearing and the lower mud bearing define an axial direction and a radial direction of the first non-rotary steering sleeve.

3. The rotary steerable drilling tool according to claim 1, wherein the near-bit-end mud bearing defines an axial direction and a radial direction of the second non-rotary steering sleeve.

4. The rotary steerable drilling tool according to claim 1, further comprising a bow spring device mounted on the first non-rotary steering sleeve by a retaining cover, wherein, during operation, the bow spring device presses against a wall in a wellbore so that a friction between the bow spring device and the wall limits a speed of rotation of the first non-rotary steering sleeve.

5. The static push-the-bit articulated high-built-rate rotary steerable tool according to claim 1, wherein a plurality of wear-resistant ribs are mounted on an outer surface of the second non-rotary steering sleeve.

6. The rotary steerable drilling tool according to claim 1, further comprising: a centering connecting shaft, a first circuit disposed on the rotary mandrel, a central control circuit, wherein, during operation, electric power and communication signals from a measuring-while-drilling instrument (MWD) are transferred to the first circuit via the centering connecting shaft, and the first circuit transfers the electric power and the signals to the central control circuit via a non-contact electric power transmission transformer.

7. The rotary steerable drilling tool according to claim 6, wherein the first circuit is sealed in a cavity in a proximal portion of the rotary mandrel by a sealing cover plate, and the first circuit is electrically connected with the centering connecting shaft via a connector.

8. The drilling tool according to claim 6, wherein each of the one or more pistons resides in one of three sets of independent motor pump hydraulic modules affixed on an outer wall of the first non-rotary steering sleeve, wherein each of the three motor pump hydraulic modules has a hydraulic system which generates high-pressure oil to actuate a corresponding piston.

9. The drilling tool according to claim 1, further comprising a mud turbine generator for generating electric power disposed on an inner shoulder of a drill collar, and electrically connected with an upper-end interface of the rotary steerable tool via a lower-end interface of the mud turbine generator.

10. A method for operating the rotary steerable drilling tool according to claim 6, comprising:

setting a target tool face in the central control circuit;

determining, by the central control circuit, a current tool face based on signals from acceleration and fluxgate sensors;

calculating, by the central control circuit, a target steering force vector according to the target tool face, and decomposing the target steering force vector into a plurality of forces applied to the one or more pistons;

applying a hydraulic pressure based on each of the plurality of forces to each of the one or more pistons;

acquiring and monitoring, by the central control circuit, a current gravitational tool face value in real time, when the current gravitational tool face value varies, recalculating the target steering force vector and decomposing the recalculated target steering force vector into a plurality of adjusted forces applied to the one or more pistons;

applying an adjusted hydraulic pressure based on each of the plurality of adjusted forces to each of the one or more pistons, whereby controlling the drill bit to follow a pre-determined wellbore trajectory.

* * * * *